United States Patent [19]

Schwartz

[11] Patent Number: 4,651,617

[45] Date of Patent: Mar. 24, 1987

[54] DRUM STRIKING INSTRUMENT

[76] Inventor: Paul D. Schwartz, 10 Gorski St., Amsterdam, N.Y. 12010

[21] Appl. No.: 846,118

[22] Filed: Mar. 31, 1986

[51] Int. Cl.[4] ..... G10D 13/02

[52] U.S. Cl. ..... 84/422 S

[58] Field of Search ..... 84/422 R, 422 C, 422 S

[56] References Cited

U.S. PATENT DOCUMENTS 2,905,043 9/1959 Soderberg ..... 84/422 S 3,688,013 8/1972 Menard ..... 84/422 S

*Primary Examiner*—Lawrence R. Franklin

*Attorney, Agent, or Firm*—Heslin & Rothenberg

[57] ABSTRACT

A drum striking instrument capable of being used to produce single stroke, multiple drum beat rolls and, alternatively, capable of being used in a manner similar to any standard drumstick. The striking instrument has an elongated main body with a first head on one end. Pivotally attached, and biased at a particular angle relative to the main body is an elongated side body having a second head on its free end.

10 Claims, 7 Drawing Figures

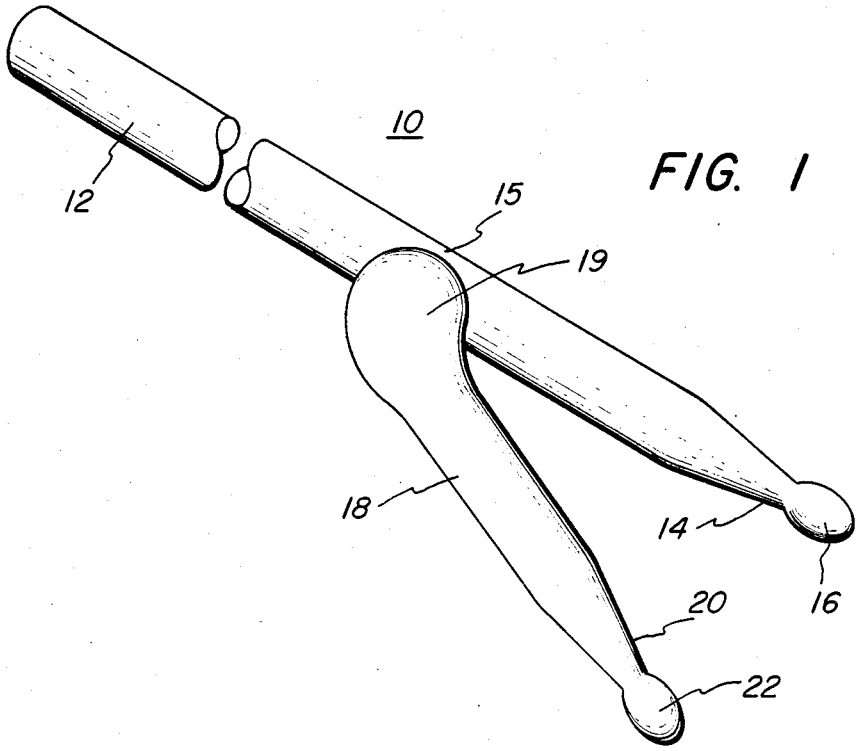
FIG. 1
FIG. 2
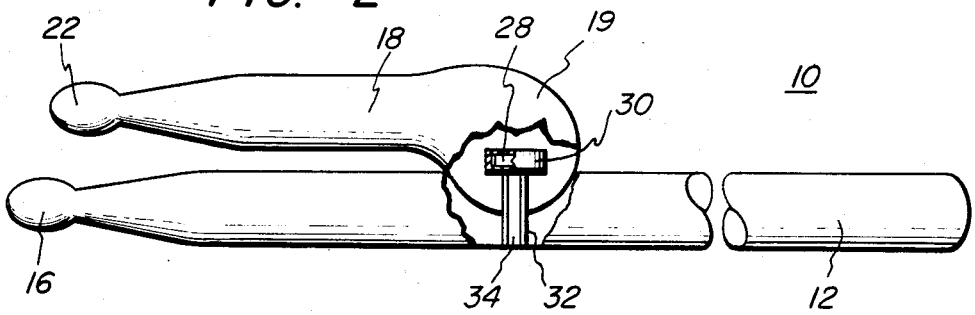
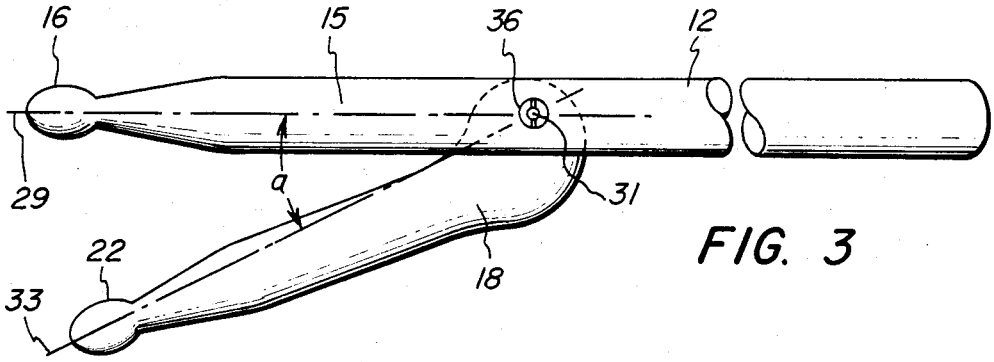
FIG. 3

DRUM STRIKING INSTRUMENT

BACKGROUND OF THE INVENTION

The present invention relates in general to musical instruments and more particularly, to an improved hand-operated drum striking instrument capable of producing a single strike, multiple drum beat roll.

In the production of music, it is now common practice to use drums as at least part of the rhythm section. Although considerable effort has been directed to the improvement of drums and other percussion instruments, little has been done with respect to the striking instrument, that is, the drumstick.

There have traditionally been two basic types of drumsticks. The brush type which is used to produce a sweeping sound and the stick type which is used to produce a much stronger or more percussive sound. Improvement efforts relating to drum striking instruments have almost exclusively centered on varying the physical characteristics of these two basic types of drumsticks. For example, attempts have been made to optimize weight, size, construction and versatility of these drumstick types. Little effort, however, has been directed to the creation of new drum striking instruments.

Since it is often desirable to have a drummer "fill" the background of music being played, a drummer's skill is frequently measured by his ability to produce a large number of drum beats in a given length of time. The problem associated with both the brush type and the stick type drumsticks is that they are only able to be used to strike a drum or other percussion instrument one beat at a time. These drumsticks are, therefore, of minimal assistance to a drummer desiring to produce controlled, multiple beat rolls.

One attempted solution to this problem was disclosed by Menard in U.S. Pat. No. 3,688,013. In that patent, Menard described a drum striking instrument for producing a multiple drum beat ruff. The instrument consisted of a standard drumstick to which a flexible element having one or more heads was attached. The Menard drum striking instrument, however, has failed to fully eliminate for drummers the above noted problem. A drummer still has to possess a relatively high degree of skill before the Menard instrument will be useful in producing controlled, rhythmic drum beat rolls. This is because the unrestrained flexibility of the attached element provides little control for, or assistance to a drummer attempting to maintain a consistent drum beat roll. The unrestrained flexibility of the attached element also limits the versatility of the Menard instrument for any use other than producing a multiple beat ruff.

Therefore, there presently exists a need for a drum striking instrument capable of providing even an inexperienced drummer with the means for playing consistent, rhythmic drum beat rolls, yet versatile enough to also be used in a manner similar to any traditional drumstick.

SUMMARY OF THE INVENTION

Accordingly, it is a principal object of the present invention to provide an improved drum striking instrument capable of being used to produce controlled, rhythmic drum beat rolls.

Another object of the present invention is the provision of such a drum striking instrument which is also capable of being used in a manner similar to any standard drumstick.

Yet another object of the present invention is the provision of such a drum striking instrument which is capable of being used by a drummer in just one hand to produce multiple drum beat rolls.

A further object of the present invention is the provision of such a drum striking instrument which is capable of being used to produce a plurality of beats with each stroke of the instrument on a drum.

A still further object of the present invention is the provision of such a drum striking instrument wherein the drum beat timing within a rhythmic drum roll may be easily varied.

It is another object of the present invention to provide such a drum striking instrument which will permit an unskilled drummer to provide musical background fill similar to that produced by a skilled drummer.

It is yet another object of the present invention to provide such a drum striking instrument which is light weight in construction and inexpensive to produce.

The present invention satisfies these objects by providing an instrument consisting of a standard drumstick, essentially comprising an elongated main body with a first head at one end, and an elongated side body pivotally attached near one of its ends to the standard drumstick. The side body has a second head at its opposite end and is biased at a particular, and preferably acute, angle relative to the main body. Additionally, the tension at which the side body is biased and the angle at which it is biased will preferably be adjustable.

To produce a single stroke, multiple drum beat roll, a drummer would first bring the second head into contact with a drum face (producing a first beat), then cause the first head to contact the drum face by applying downward pressure on the instrument (producing a second beat), and finally lift the instrument so that neither the first or second head contacted the drum face (producing a third beat). In addition, by simply turning the instrument in his hand, the drummer could use the elongated main body having the first head in a manner similar to any standard drumstick.

BRIEF DESCRIPTION OF THE DRAWINGS

For a more complete understanding of the present invention and the objects, features, advantages and benefits thereof, reference is now made to the following description taken in conjunction with the accompanying drawings in which:

FIG. 1 is a perspective view of one preferred embodiment of the drum striking instrument of the present invention;

FIG. 2 is a plan view of the embodiment shown in FIG. 1 partially cut away;

FIG. 3 is a side view of the embodiment shown in FIG. 1;

DETAILED DESCRIPTION OF THE INVENTION

Figure 4:
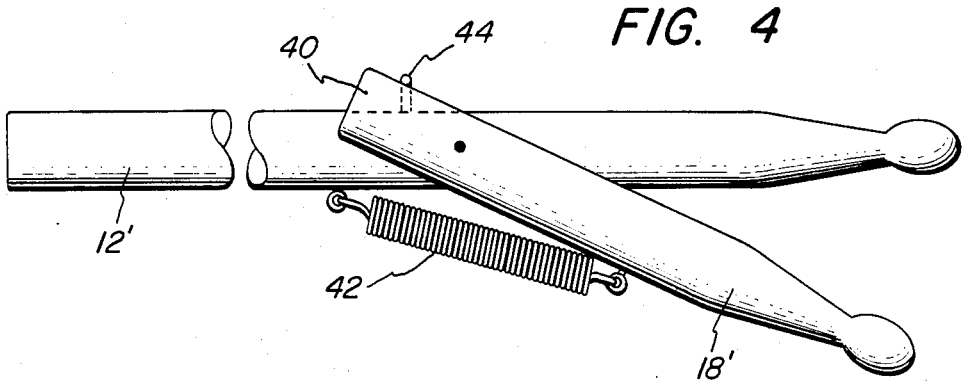
FIG. 4 is a perspective view of one alternate embodiment of the drum striking instrument of the present invention.

One preferred embodiment of the present invention is illustrated by way of example in FIGS. 1–3. With specific reference to FIG. 1, the drum striking instrument is generally denoted as 10.

The instrument 10 has an elongated main body 12 which may be formed of any known, suitable material. It is provided at one end with a tapered portion 14 at the end of which there is a first head 16. First head 16 may be either integrally formed of the same material as main body 12 or separately manufactured and detachably connected to main body 12.

Elongated side body 18 is attached at one end 19 to main body 12, preferably adjacent that portion 15 having first head 16. Side body 18 preferably is attached to main body 12 near first head 16 in order to minimize the overall size and weight of drum striking instrument 10, although obviously it may be attached to other portions of main body 12 without departing from the scope of the present invention as defined by the appended claims. At the end opposite from that which is attached to main body 12, side body 18 is also provided with a tapered portion 20 at the end of which there is a second head 22.

Preferably, second head 22 and first head 16 will be manufactured of the same material and be substantially the same size. In addition, drum striking instrument 10 will preferably be constructed such that first head 16 and second head 22 will be in substantial alignment when main body 16 and side body 18 are parallel (not shown), that is, neither will extend in length beyond the other. Constructing the heads from the same material, to substantially the same size, and providing that they will be in substantial alignment when the bodies are parallel, will produce greater sound uniformity when the two heads separately contact a drum face. Of course, any one or all of these parameters may be varied in order to achieve drum beats of different sound if desired.

Central to the present invention is the biasing of side body 18 at a particular angle relative to main body 12. This biasing may be accomplished by any of a variety of readily available means. Referring to FIG. 2, the illustrated embodiment uses coiled spring 28 to bias side body 18 relative to main body 12. In the preferred embodiment, there will be two adjustable parameters, the tension of coiled spring 28 and the angle at which side body 18 is biased relative to main body 12. The tension adjustment will dictate the force or pressure needed in order to pivot side body 18 relative to main body 12 and the angle of bias will be a factor in determining the time interval between successive drum beats. In this preferred embodiment, therefore, by being able to vary these parameters each drummer would have control over the tone and timing of a multiple drum beat roll.

As can be seen in FIG. 2, coiled spring 28 is located within casing 30 which is embedded within enlarged end 19 of side body 18, which is itself preferably partially recessed within main body 12 so as to effectively form a movable, that is, pivotable, joint. By embedding casing 30 within end 19 of side body 18 and partially recessing side body 18 within main body 12, a more streamlined appearance to instrument 10 is obtained. In such a streamlined instrument all edges which could cause injury to the drummer or damage to a drum are eliminated.

As also shown in FIG. 2, a transverse bore 32 is provided through main body 12 and partially into end 19 of side body 18 to casing 30. Within transverse bore 32 is located the mechanical means, generally denoted as 34, for pivotally locking side body 18 at a particular angle of bias relative to main body 12 and for adjusting the spring tension. Such mechanical means 34 may be implemented in any of a number of ways which are commonly known in the art. In the illustrated embodiment, mechanical means 34 will include two adjustments, a master lock screw having a slit head adjustment and a spring tension set screw located therein, having an hexagon head adjustment. (See FIG. 3). Preferably, the slit head adjustment and hexagon head adjustment will be recessed flush with the exterior of main body 12. To adjust the spring tension, an individual would first loosen the master lock screw, make the desired spring tension set screw adjustment and then retighten the master lock screw. Additionally, the angle of bias, a, could be easily set by holding side body 18 at the desired angle as the master lock screw is being retightened. Such a master lock assembly is preferable in light of the forces drum striking instrument 10 may experience when in use.

As best seen in FIG. 3, a straight line 33 drawn through pivot point 31 and the middle of second head 22 of side body 18 will preferably form a particular acute angle, a, at which second head 22 of side body 18 is biased relative to axis 29 of main body portion 15. It is believed that instrument 10 best produces a multiple drum beat roll when angle, a, is set within the 22° to 25° range. When used to produce a multiple drum beat roll, side body 18 of instrument 10 will depend downward relative to main body 12 such that second head 22 will be the first to strike a drum face, as discussed below.

In the preferred embodiment there will be both left and right handed drum striking instruments. For improved control of the multiple drum beat produced, it has been found beneficial to have side body 18 facing the drummer so that the pivoting action relative to main body 12 may be monitored. Thus, in FIGS. 1–3 a left handed instrument has been depicted, although clearly the illustrated instrument could also be used in the right hand to produce a multiple drum beat roll.

One of the many possible alternate embodiments of the present invention is illustrated perspectively in FIG. 4. Briefly, in this embodiment, an elongated main body 12' has an elongated side body 18' pivotally attached thereto. Main body 12' and side body 18' have characteristics similar to those discussed in connection with main body 12 and side body 18 of the embodiment illustrated in FIGS. 1–3, including a tapered portion at the end of which is located a head. However, in this embodiment, side body 18' has an extended portion 40 beyond that point where it is pivotally attached to main body 12'. A spiral spring 42 is used to bias side body 18' at a particular angle relative to main body 12'. The spring tension within spiral spring 42 could easily be varied by changing the location on main body 12' at which the spiral spring 42 is attached. This could be accomplished, for example, by providing a number of spaced, threaded openings (not shown) into which a connecting screw affixed to the spiral spring 42 could be selectably inserted. A stop arm 44 is also shown. Stop arm 44 engages extended portion 40 of side body 18' to define the particular angle at which side body 18' is biased. The particular angle of bias could be easily varied by raising or lowering the stop arm 44 relative to the main body 12'. This could obviously be accomplished by any of a variety of readily available means.

Figures 5A, 5B, 5C:
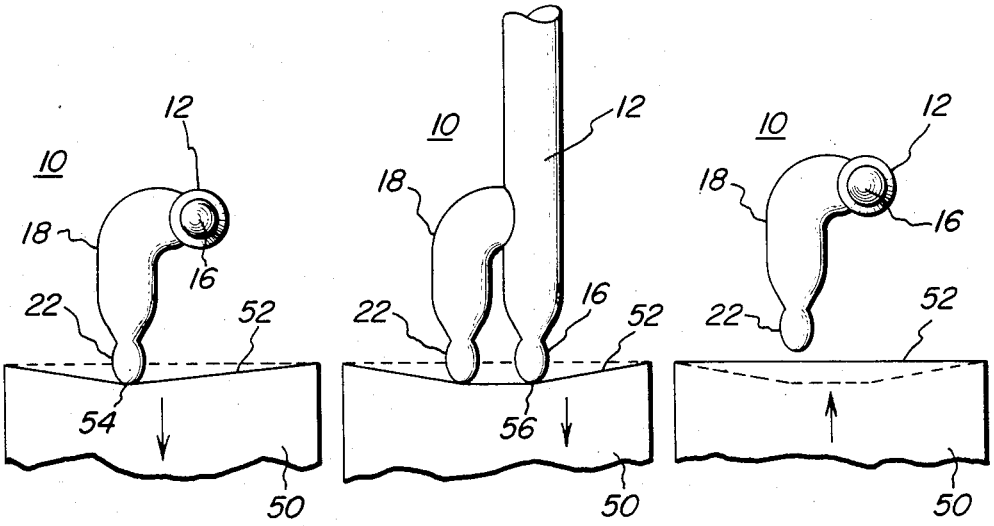
FIG. 5*a* is a functional depiction of the drum striking instrument illustrated in FIGS. 1–3 as the second head is brought into contact with a drum face.
FIG. 5*b* is a continuation of FIG. 5*a* and depicts the drum striking instrument as the first head is forced downward into contact with the drum face.
FIG. 5*c* is a continuation of FIGS. 5*a* and 5*b* and depicts the drum striking instrument as it is sufficiently lifted to remove the first and second heads from direct contact with the drum face.

The functioning of the present invention, as currently understood, will now be described with reference to FIGS. 5*a–c*. As noted earlier, drum striking instrument 10 of the present invention may be used to produce a single stroke, controlled, multiple drum beat roll. A single drum roll using this instrument would consist of the audible sounds produced as follows. A first sound or beat would be produced when second head 22 contacts face 52 of drum 50, an action which would force face 52 downward at the point of contact 54 (FIG. 5*a*). By pressing downward on instrument 10, a second beat would be produced when first head 16 contacts face 52 of drum 50 forcing the face further downward at point of contact 56 (FIG. 5*b*). A third and last beat would be produced when drum striking instrument 10 has been sufficiently lifted to remove both heads from direct contact with drum face 52 (FIG. 5*c*). This third beat is believed to be produced as a reactionary sound to the return of the drum face 52 to its initial position.

A drummer could alternatively use the drum striking instrument of the present invention in a manner similar to any standard drumstick simply by rotating instrument 10 in his hand such that only first head 16 of main body 12 would contact a drum or other percussion instrument.

It will be noted that this invention fully meets the objectives set forth. A drum striking instrument is provided which will allow even an inexperienced drummer to play controlled, rhythmic drum beat rolls, and which can alternatively be used in a manner similar to any standard drumstick. Further, a drum striking instrument is provided which will allow an individual to easily vary the timing between beats and the tone of a particular beat within a drum roll.

Although two embodiments have been illustrated in the accompanying drawings and described in the foregoing description, it will be understood that the invention is not limited to the embodiments discussed but is capable of numerous rearrangements, modifications and substitutions without departing from the scope of the invention. For example, a plurality of elongated side bodies may be added to a main body to produce more complicated drum rolls. Other changes, within the scope of the invention as defined by the appended claims, will suggest themselves to those skilled in the art.

I claim:

1. An improved drum striking instrument, comprising:

an elongated main body having a first head at one end;

an elongated side body having a second head at one end and pivotally attached near its other end to said main body; and means for biasing said side body so that the second head is located at a particular angle relative to that portion of said main body having the first head, whereby the improved drum striking instrument may be used in connection with a drum to produce a controlled, single stroke, multiple drum beat roll.

2. The improved drum striking instrument of claim 1, wherein said side body is pivotally attached to said main body at a point adjacent the first head.

3. The improved drum striking instrument of claim 2, wherein said biasing means is adjustable.

4. The improved drum striking instrument of claim 3, wherein said adjustable biasing means includes:

means for adjusting the particular angle at which said second head of said side body is biased relative to that portion of said main body having the first head; and means for adjusting the tension at which said side body is biased relative to said main body.

5. The improved drum striking instrument of claim 4, wherein a straight line extending from the middle of said second head to the point of pivotal attachment of said side body forms an acute angle with an axis of that portion of the main body having the first head.

6. The improved drum striking instrument of claim 5, wherein said acute angle is within a twenty-two to twenty-five degree range.

7. An improved hand-operated drum striking instrument capable of being used as a standard drumstick or capable of being used to produce a single stroke, multiple drum beat roll, comprising:

an elongated main body having a first head at one end;

an elongated side body having a second head at one end and pivotally attached near its other end to said main body at a point adjacent the first head; and means for biasing said side body so that the second head is located at a particular acute angle relative to that portion of said main body having the first head, whereby the elongated main body having the first head at one end may be used as a standard drumstick by first causing said first head to strike a drumface and alternatively, the multiple drum beat roll may be produced by first bringing the second head into contact with a drum face, then applying downward pressure to the instrument until the first head contacts the drum face, and finally lifting the instrument so as to remove the first and second heads from direct contact with the drum face.

8. The improved hand-operated drum striking instrument of claim 7, wherein said biasing means is adjustable.

9. The improved hand-operated drum striking instrument of claim 8, wherein said adjustable biasing means includes:

means for adjusting the particular acute angle at which said second head of said side body is biased relative to that portion of said main body having the first head; and means for adjusting the tension at which said side body is biased relative to said main body.

10. The improved hand-operated drum striking instrument of claim 9, wherein the particular acute angle of bias is within a twenty-two to twenty-five degree range.

* * * * *